US007665525B2

(12) United States Patent
Pfefferle

(10) Patent No.: US 7,665,525 B2
(45) **Date of Patent: *Feb. 23, 2010**

(54) REDUCING THE ENERGY REQUIREMENTS FOR THE PRODUCTION OF HEAVY OIL

(75) Inventor: William C. Pfefferle, Madison, CT (US)

(73) Assignee: Precision Combustion, Inc., North Haven, CT (US)

( * ) Notice: Subject to any disclaimer, the term of this patent is extended or adjusted under 35 U.S.C. 154(b) by 33 days.

This patent is subject to a terminal disclaimer.

(21) Appl. No.: 11/439,392

(22) Filed: May 22, 2006

(65) Prior Publication Data

US 2006/0260814 A1 Nov. 23, 2006

Related U.S. Application Data

(60) Provisional application No. 60/683,827, filed on May 23, 2005, provisional application No. 60/684,861, filed on May 26, 2005.

(51) Int. Cl.
*E21B 36/02* (2006.01)
*E21B 43/24* (2006.01)

(52) U.S. Cl. ..... 166/303; 166/272.1; 166/272.3; 166/272.7

(58) Field of Classification Search ..... None
See application file for complete search history.

(56) References Cited

U.S. PATENT DOCUMENTS 3,223,166 A * 12/1965 Hunt et al. ..... 166/300
3,244,231 A * 4/1966 Grekel et al. ..... 166/300
3,804,163 A * 4/1974 Bradley et al. ..... 166/59
3,817,332 A * 6/1974 Berry et al. ..... 166/302
3,980,137 A * 9/1976 Gray ..... 166/256
4,237,973 A * 12/1980 Todd ..... 166/59
4,397,356 A * 8/1983 Retallick ..... 166/303
4,687,491 A * 8/1987 Latty ..... 44/301
5,163,511 A * 11/1992 Amundson et al. ..... 166/303
6,358,040 B1 * 3/2002 Pfefferle et al. ..... 431/7
6,394,791 B2 * 5/2002 Smith et al. ..... 431/170
6,973,968 B2 * 12/2005 Pfefferle ..... 166/260
7,343,971 B2 * 3/2008 Pfefferle ..... 166/260
2005/0239661 A1 * 10/2005 Pfefferle ..... 507/100

* cited by examiner

*Primary Examiner*—George Suchfield
(74) *Attorney, Agent, or Firm*—Robert L. Rispoli

(57) ABSTRACT

A method for generating a heated product stream downhole is provided wherein a fuel rich mixture is reacted downhole by contact with a catalyst to produce a partially reacted product stream, the fuel rich mixture comprising fuel and oxygen. The partially reacted product stream is brought into contact with an oxidant thereby igniting combustion upon contact producing a combustion product stream. The combustion product stream may be cooled by injecting a diluent flow such as water or $CO_2$. The cooled combustion product stream may be into an oil bearing strata in order to reduce the energy requirements for the production of heavy oil.

14 Claims, 2 Drawing Sheets

REDUCING THE ENERGY REQUIREMENTS FOR THE PRODUCTION OF HEAVY OIL

CROSS-REFERENCE

This application claims the benefit of U.S. Provisional Application No. 60/683,827 filed May 23, 2005, and U.S. Provisional Application No. 60/684,861 filed May 26, 2005.

FIELD OF THE INVENTION

The present invention is generally directed to a method and apparatus for enhancing the mobility of crude oils. More particularly, this invention enables efficient and effective recovery of heavy oils not presently accessible using existing techniques. The present invention also allows production of upgraded oils from the heavy oil deposits. In sum, the heavy oil that remains inaccessible after primary and secondary recovery operations, and the significant amounts of heavy oils that reside at depths below those accessible with conventional steam flooding operations, such as employed in California and Alberta fields, are made accessible with the present invention.

BACKGROUND OF THE INVENTION

The industrial world depends a great deal on petroleum for energy. However, it has become increasingly clear that long term production cannot keep pace with the rapidly growing need, particularly in view of the growing demand from industrially developing countries.

Heavy oils represent by far the larger portion of the world's oil in place, yet represent only a minor portion of world oil production. With the normal yearly decrease in production from existing wells, production level can only be maintained by opening up new fields. Although the world is in no danger of soon running out of oil, it has become increasingly difficult to find new conventional oil fields. Thus, it is recognized that at some time in the not too distant future, production of conventional crude oils will peak and thereafter decrease regardless of continuing new discoveries. Thus, in the future, greatly increased production of heavy oils will be required.

Such heavy oil deposits can be recovered by mining and upgrading the recovered oil. However, by far the bulk of such heavy oil reserves occur at depths greater than that from which it can be recovered by known surface mining techniques. To overcome problems associated with such surface mining techniques, steam flooding extraction methods such as Steam Assisted Gravity Drainage ("SAGD") have been developed. Steam flooding from surface steam generators is an effective and broadly applicable thermal recovery approach to enhanced oil recovery. The primary effects are reducing oil viscosity enough to allow flow and displacing the oil toward a production wellhead. The oil removed tends to be the more mobile fraction of the reservoir. However, in order to ensure compliance with national and local air pollution emission regulations, use of steam generators and the combustion emissions therefrom can limit their use, particularly in areas with more stringent emission regulations as in California.

Prior art steam flooding techniques face other limiting technical and economic obstacles relating to conductive heat losses through the wellbore and incomplete reservoir sweep efficiency, especially in heterogeneous reservoirs. This limits the depth from which oil can be recovered. In addition, steam boilers require relatively clean water to minimize fouling of heat transfer surfaces. Further, surface water is not always available. Without improved technology to deal with these issues, it is unlikely that heavy oil production can expand sufficiently to meet the growing demand for oil.

To overcome the wellbore heat loss problems involved in surface steam generation, there has been work on producing the steam downhole. Sandia Laboratories, under the U.S. Department of Energy ("DOE") sponsorship, operated a downhole direct combustion steam generator ("Project Deepsteam") burning natural gas and diesel at Long Beach, Calif., in the Wilmington field. Although there were initial problems relating to steam injectivity into the reservoir, results demonstrated the advantages in terms of reduced heat losses. However, the Project Deepsteam approach exhibited problems with soot formation in stoichiometric operation.

In a more advanced approach, in the 1980's Dresser Industries developed a catalytic downhole steam generator burning oil-water emulsions as described in U.S. Pat. Nos. 4,687,491 and 4,950,454. This approach eliminated soot formation and reduced heat loss in supplying steam to a formation, but it still required high purity water to avoid contaminate deposition on the catalyst. Moreover, heat output was limited by the need to vaporize the heavy oil used as fuel. Thus, these approaches have not been commercially employed.

Another problem associated with generating heat downhole is the lack of a robust method for the startup of the heat-generating operation. For example, spark igniters require exceedingly high voltage in applications exposed to high pressure. In another example, the use of a glow plug exposes the heat-generating operation to considerable downtime because of the glow plug's characteristically short life span.

With worldwide consumption of petroleum increasing year-by-year, there is a need to more efficiently produce oil from heavy crude oil deposits. Accordingly, there is need for a method of downhole heat generation which avoids the limitations of the prior art. More particularly, there is a need for a method of steam generation which reduces heat losses and does not rely on the availability of surface water, particularly if such method can utilize reservoir water without cleaning such water to boiler quality water. In addition, there is a need for such a method wherein ignition-on-contact is inherent.

SUMMARY OF THE INVENTION

The present invention comprises a novel process for downhole combustion of fuel to enable production of heavy oils, even from depths below those accessible using surface generated steam. Based on an adaptation of the method described in U.S. Pat. No. 6,358,040, incorporated in its entirety herein by reference, the present invention makes possible the design of high throughput combustors compact enough to fit within a well bore yet having heat outputs in excess of thirty million BTUs per hour at 100 atmospheres pressure. Unlike U.S. Pat. No. 6,358,040, stoichiometric or fuel-rich mixtures are formed upon mixing the partially reacted fuel stream with the reactor cooling air. Heat outputs exceeding fifty or eighty million BTUs at 100 atmospheres pressure hour are viable. High flow velocities are feasible, in comparison to conventional gas turbine combustors, because no flame zone expansion is required in order to create low velocity zones for flame stabilization.

Unlike conventional flame combustion, the method of the present invention allows stoichiometric or rich flame zone combustion without soot formation. Such stoichiometry is required in order to minimize the presence of significant quantities of free oxygen in the product stream. Water or $CO_2$ is injected into the hot combustion gases to generate steam (in the case of water) and reduce the combustion product stream temperature to the desired value as dictated by the reservoir requirements. Use of carbon dioxide in place of water provides for disposal of carbon dioxide often produced with natural gas.

In one embodiment of the present invention, gaseous fuel and oxidant (air or oxygen-rich gas) are supplied from the surface at the pressure required for injection of the cooled combustion product stream into the oil bearing strata. Natural gas is a preferred fuel and as-produced gas comprising carbon dioxide may be used. Water may be supplied either from the surface or from downhole water-bearing strata.

Typically, oxidant is supplied by a surface mounted compressor. Oxygen also may be supplied from an air liquefaction plant avoiding the energy consumption of a high pressure oxidant compressor. Liquid oxygen from the fractionating tower can be elevated to the required pressure by a pump prior to gasification, as also can be accomplished with liquid air. This still allows use of the cold liquid oxygen and the nitrogen-rich streams to chill air in the air liquefaction unit. Gaseous carbon dioxide, advantageously pumped to pressure as a liquid, may be blended with the pressurized oxygen to limit combustion flame temperature. The high reactivity of pure oxygen as oxidant can be disadvantageous but allows use of non-catalytic combustor designs. In one such design, oxygen is injected into a co-flowing stream of carbon dioxide-rich natural gas forming an annular flame of controlled temperature around an oxygen core. In such a burner, the flame temperature may be controlled to a predetermined value by adjustment of the concentration of carbon dioxide in either the oxidant or the carbon dioxide-rich natural gas or in both.

Referring back to the method described in U.S. Pat. No. 6,358,040, a preferred embodiment of the present invention comprises dividing an oxidant flow into two flow streams. The first oxidant flow stream is mixed with fuel to form a gaseous fuel-rich fuel/air mixture. The fuel-rich fuel/air mixture is introduced into a flowpath that passes over, and in fluid communication with, the catalytically-coated exterior surface of cooling air tubes to form a partially reacted product stream. The second oxidant flow stream is introduced into the cooling tubes to backside cool the catalyst. The partially reacted product stream is then contacted with the cooling air exiting the cooling tubes and ignites on contact.

Combustion of the partially reacted product stream and the second oxidant flow stream produces a combustion product stream comprising hot combustion gases downhole, preferably proximate to oil-bearing strata. A diluent such as water is injected into the hot combustion gases to generate steam and reduce the temperature of the combustion product stream to the desired value as dictated by the particular application or reservoir requirements. As described hereinabove, $CO_2$ also may be used as a diluent.

The partially reacted product stream must comprise a sufficient degree of conversion of the gaseous fuel. The operation parameters necessitate appropriately controlling the type of fuel and the temperature and pressure of the conversion apparatus, typically a catalytic combustor. Such operating parameters are well known in the prior art. In a preferred embodiment of the present invention, light-off of the catalytic reaction occurs upon contact. Light-off of the catalytic reaction may be enhanced by electrically heating a portion of the catalytically coated tubes, as with a cartridge heater, or by use of a start up preburner.

In these and other embodiments of the present invention, crude oil viscosity is reduced by heating the oil, as in conventional steam flooding; however, high-purity water is not required. If carbon dioxide is used to cool the combustion product stream, no water is required. This allows use of the present method where no water is available. If so desired, the temperature of the cooled fluid can be high enough to promote oil upgrading by cracking. Regardless, sweep efficiency is improved via enhancement of mobility and control of reservoir permeability as a result of the reduction of oil viscosity.

The present invention significantly increases available domestic oil reserves. Dependence on oil imports is decreased by making oil available from the abundant deposits of otherwise inaccessible heavy oils. Fuel, air, water, and CO2 typically are easily transported downhole from the surface. The present invention provides numerous benefits because it is highly adaptable within a number of controllable variables. Because oil fields differ and the task of recovery varies in each case, these variables can be adjusted to fit the particular reservoir conditions.

BRIEF DESCRIPTION OF THE DRAWINGS

Oil mobilization in accordance with the present invention is illustrated in the drawings in which.

DETAILED DESCRIPTION OF THE INVENTION

Figure 1:
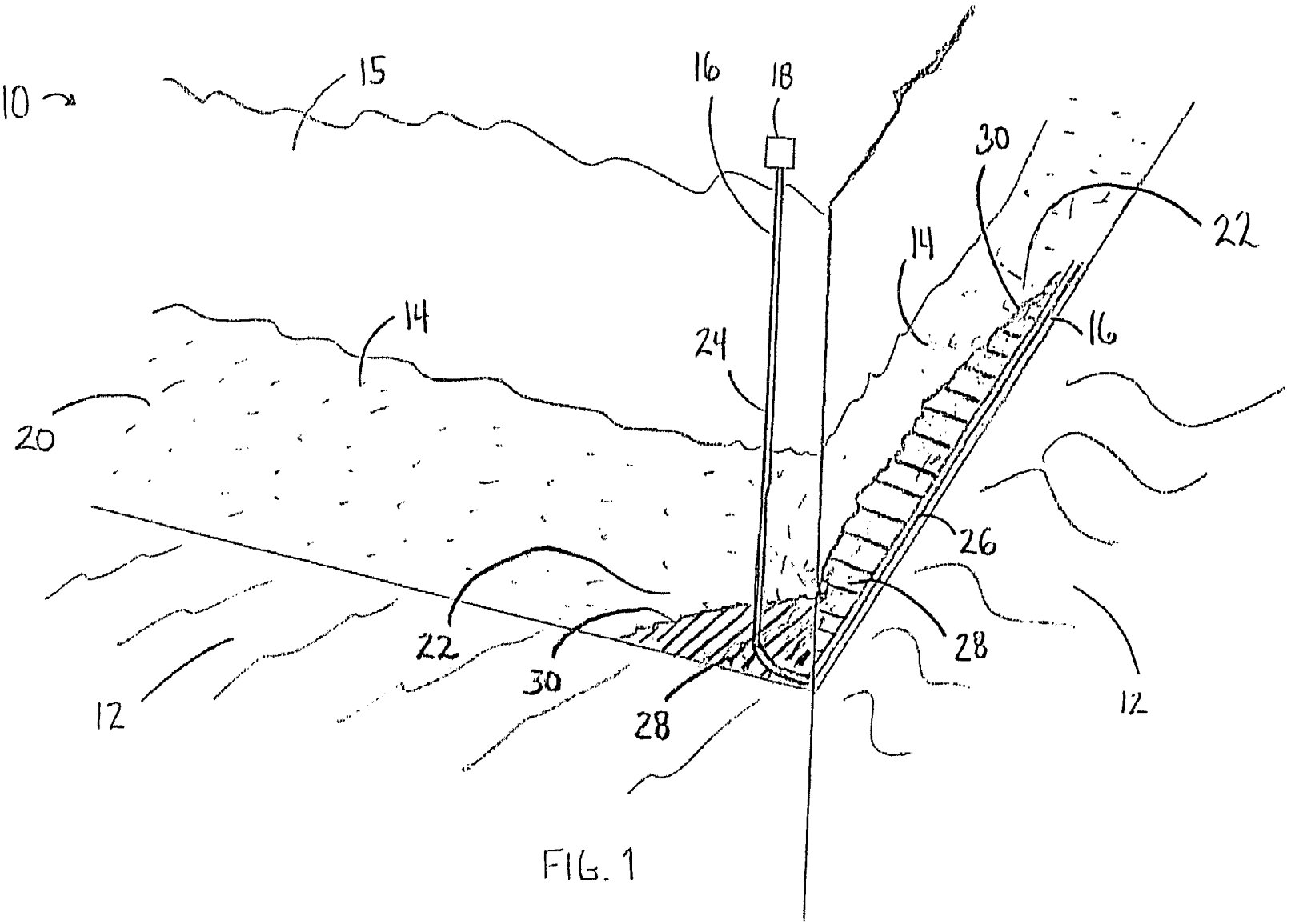
FIG. 1 is a cut-away isometric representation of an oil-bearing formation having a well into which a combustor may be placed.

With reference to catalytic combustion system 10 of FIG. 1, low permeability layer 12 underlays oil-bearing sand deposit 14. Sand deposit 14 underlays overburden layer 15 which consists of shale, rock, permafrost, or the like. Sand deposit 14 defines an upslope region 20 and a downslope region 22. Well 16 extends downward from wellhead 18 on the surface. Prior to passing into low permeability layer 12, well 16 turns and extends horizontally above layer 12 along downslope region 22 of sand deposit 14.

Figure 2:
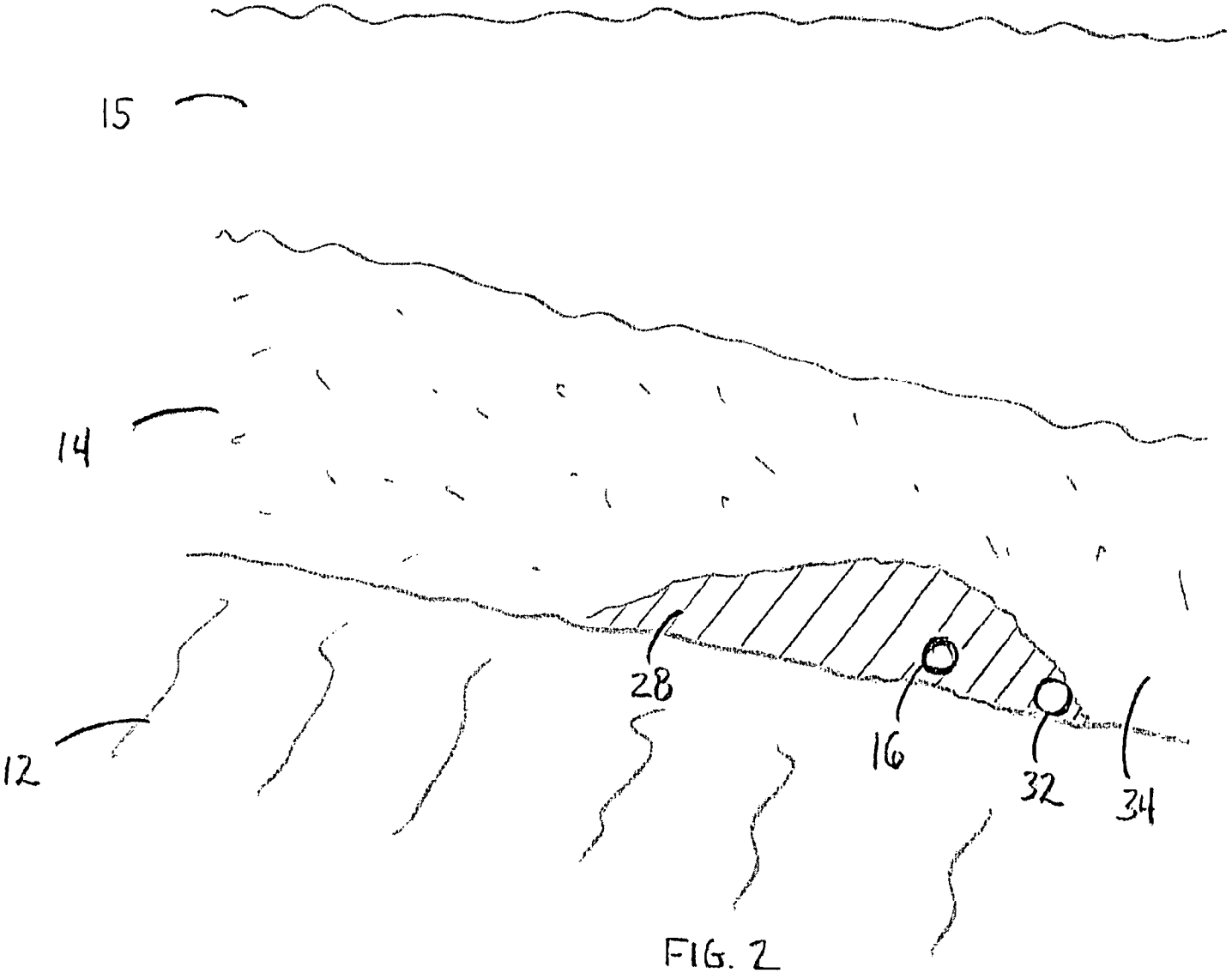
FIG. 2 is a schematic representation of the placement of a production well downstream from the injection well.

A suitable combustor (not shown) may be placed in either the vertical portion 24 or horizontal portion 26 of well 16. Hot fluid is injected into downslope region 22 of sand deposit 14 through the horizontal portion 26 of well 16 thereby forming hot fluid chest 28. Mobilized oil drains downslope from interface region 30 of hot fluid chest 28 and sand deposit 14. The mobilized oil collects around well 16 and is contained upslope by low permeability layer 12 and downslope by cold immobile oil. The collected oil may be recovered via the fluid injection well 16 in a technique known in the art as huff-and-puff. Alternatively, as shown in FIG. 2, the collected oil may be withdrawn through a production well 32 located downslope of well 16 along horizontal portion 26 (as shown in FIG. 1) and upslope of cold region 34 which acts as a seal blocking the flow of the mobile oil downslope.

While the present invention has been described in considerable detail, other configurations exhibiting the characteristics taught herein for efficient and effective recovery of heavy oils by catalytically or non-catalytically generating heat downhole and thereby enhancing the mobility of crude oils are contemplated. Therefore, the spirit and scope of the invention should not be limited to the description of the preferred embodiments described herein.

The invention claimed is:

1. A method for generating a heated product stream downhole comprising:

a) reacting a fuel-rich mixture downhole by contact with a catalyst to produce a partially reacted product stream wherein the fuel-rich mixture comprises fuel and oxygen;

b) contacting the partially reacted product stream with an oxidant; and c) igniting combustion upon contact producing a combustion product stream.

2. The method of claim 1 including the additional steps of:

d) providing a diluent flow downhole; and e) cooling the combustion product stream by injecting the diluent flow into the combustion product stream.

3. A method for generating a heated product stream downhole comprising:

a) reacting a fuel-rich mixture downhole by contact with a catalyst to produce a partially reacted product stream wherein the fuel-rich mixture comprises fuel and oxygen;

b) contacting the partially reacted product stream with an oxidant;

c) igniting combustion upon contact producing a combustion product stream;

d) providing a diluent flow downhole;

e) cooling the combustion product stream by injecting the diluent flow into the combustion product stream; and f) injecting the cooled combustion products into an oil bearing strata.

4. A method of producing heavy oil comprising:

a) reacting a fuel-rich mixture downhole by contact with a catalyst to produce a partially reacted product stream wherein the fuel-rich mixture comprises fuel and oxygen;

b) contacting the partially reacted product stream with an oxidant;

c) igniting combustion upon contact producing a combustion product stream;

d) providing a diluent flow downhole;

e) cooling the combustion product stream by injecting the diluent flow into the combustion product stream; and f) injecting the cooled combustion product steam into an oil bearing strata.

5. The method of either claim 2 or claim 4 wherein the diluent is water.

6. The method of either claim 2 or claim 4 wherein the diluent is carbon dioxide.

7. The method of either claim 2 or claim 4 wherein the fuel comprises methane.

8. The method of either claim 2 or claim 4 wherein the fuel comprises carbon dioxide-rich natural gas.

9. The method of either claim 2 or claim 4 wherein the oxidant comprises air.

10. The method of claim 9 wherein the air is oxygen enriched.

11. The method of either claim 2 or claim 4 wherein the oxidant comprises oxygen.

12. The method of claim 11 wherein the oxygen is mixed with CO2.

13. The method of claim 11 wherein the oxygen is pumped to a desired pressure as liquid oxygen produced in an air liquefaction plant.

14. The method of claim 12 wherein the oxygen is pumped to a desired pressure as liquid oxygen produced in an air liquefaction plant.

* * * * *